US006863591B2

(12) United States Patent
Graf

(10) Patent No.: US 6,863,591 B2
(45) Date of Patent: Mar. 8, 2005

(54) DEVICE AND METHODS FOR DRESSING CARD CLOTHING

(75) Inventor: Ralph A. Graf, Freienbach (CH)

(73) Assignee: Graf + Cie AG, Rapperswil (CH)

( * ) Notice: Subject to any disclaimer, the term of this patent is extended or adjusted under 35 U.S.C. 154(b) by 0 days.

(21) Appl. No.: 10/734,728

(22) Filed: Dec. 13, 2003

(65) Prior Publication Data

US 2004/0166775 A1 Aug. 26, 2004

(30) Foreign Application Priority Data

Dec. 16, 2002 (DE) ..... 102 58 789

(51) Int. Cl.[7] ..... B24B 19/18
(52) U.S. Cl. ..... 451/28; 451/416
(58) Field of Search ..... 451/416, 417, 451/5, 11, 28, 56

(56) References Cited

U.S. PATENT DOCUMENTS 3,214,868 A * 11/1965 Riley ..... 451/347
4,327,525 A 5/1982 Ennis
5,355,560 A 10/1994 Fritzsche et al.
5,797,788 A 8/1998 Graf et al.

FOREIGN PATENT DOCUMENTS

| | | | | |
|---|---|---|---|---|
| DE | 3406160 | | 8/1984 | |
| DE | 196 05 635 | C2 | 5/1998 | |
| DE | 199 32 679 | C1 | 4/2001 | |
| EP | 957188 | A1 * | 11/1999 | ..... D01G/15/38 |
| EP | 1068927 | | 1/2001 | |
| EP | 1195457 | A2 * | 4/2002 | ..... D01G/15/38 |
| GB | 2192816 | | 1/1988 | |

* cited by examiner

*Primary Examiner*—David B. Thomas
(74) *Attorney, Agent, or Firm*—Friedrich Kueffner

(57) ABSTRACT

A device for dressing a card clothing, especially an all-steel sawtooth clothing, drawn over a preferably cylindrical drum, with a dressing system that can be moved along a path predetermined by a guide element, so that at least one element of the dressing system can be advanced in a direction that runs transversely, especially perpendicularly, to the predetermined path. The device has a remote-controlled advancing mechanism for advancing the one or more elements of the dressing system.

21 Claims, 1 Drawing Sheet

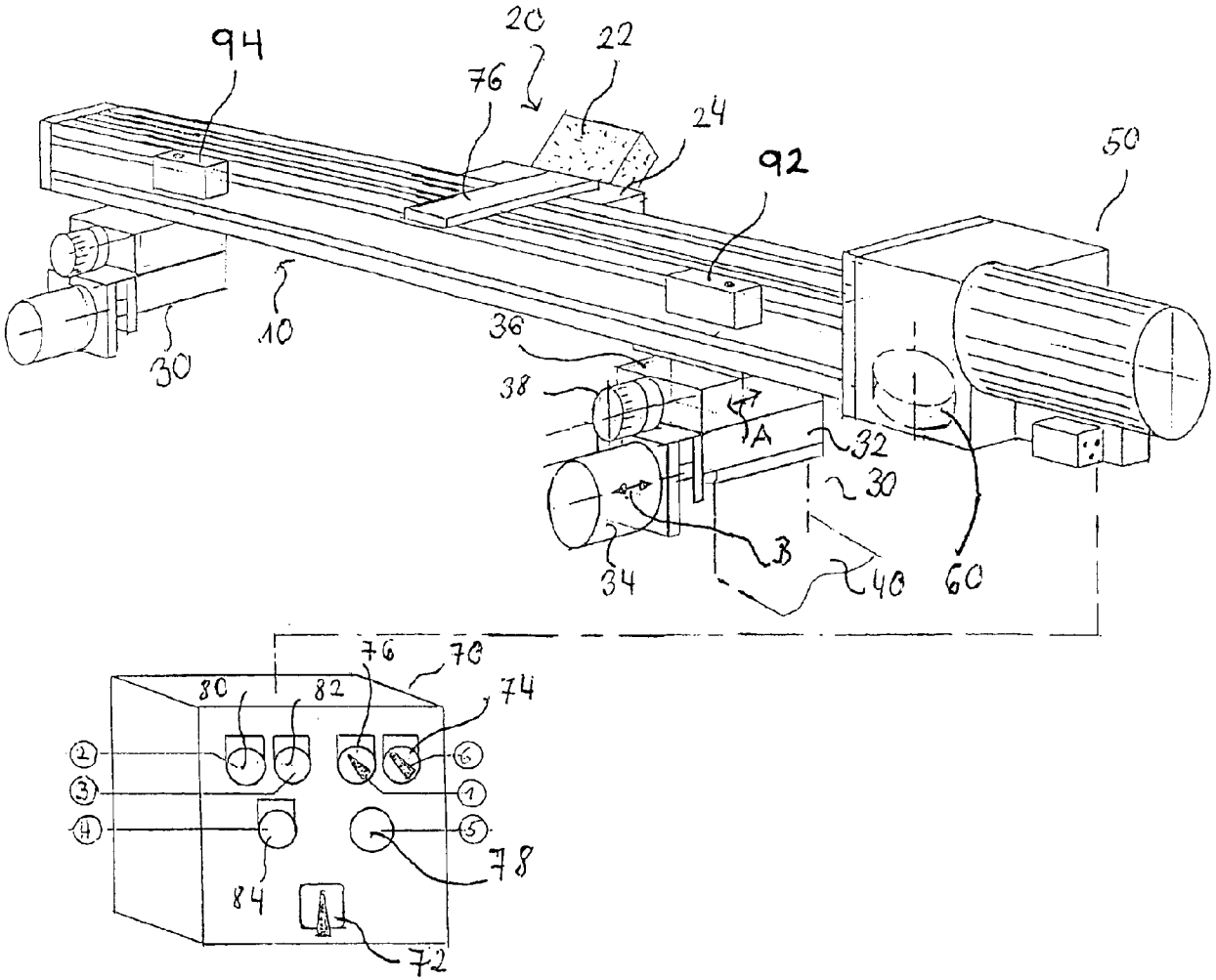
50
60
32
30
40
92
24
22
20
76
A
B
34
36
38
74
78
76
82
80
72
84
94
10
30

DEVICE AND METHODS FOR DRESSING CARD CLOTHING

BACKGROUND OF THE INVENTION

The invention relates to a device for dressing a card clothing, especially an all-steel sawtooth clothing, drawn over a cylindrical drum, with a dressing system that can be moved along a path predetermined by a guide element. At least one element of the dressing system can be advanced in a direction that runs transversely, especially perpendicularly, to the predetermined path.

In the processing of textile fibers, the fibers are straightened and cleaned with the use of cards or carding machines. These carding machines comprise a cylindrical drum, whose outer cylindrical surface is covered with card clothing. The carding operation is carried out by rotating the cylindrical drum about its cylinder axis. The clothing mounted on the cylindrical surface runs through the fiber material and straightens it, possibly in interaction with other processing elements, such as card flats, helical rollers, and the like. In addition, this carding also cleans the raw material. The carding clothing may be realized in the form of so-called needle clothing, in which individual needles penetrate an elastic support material. In many cases, of course, a so-called all-steel sawtooth clothing is used to increase wear resistance and to improve the quality of the textile fiber material. A clothing of this type comprises a sawtooth wire, which runs helically around the cylindrical drum and whose sawteeth run through the fiber material.

During the operation of the wires described above, considerable wear of the card clothing occurs. In addition, the clothing can become fouled. The latter problem occurs especially in the processing of synthetic fibers, during which the fibers melt and can adhere to the clothing. Therefore, to maintain the desired quality of the fiber material, it is necessary to dress the card clothing on a regular basis and, in the course of this dressing, to regrind the clothing tips and/or to remove fouling from the clothing.

A suitable device of the type described above for regrinding card clothing is specified, for example, in U.S. Pat. No. 5,797,788. This device comprises a dressing element realized as a grinding stone, which is mounted on a slide of the dressing system. This slide can be moved along a guide element that is realized as a guide rail. In this regard, the device is usually mounted so that the guide rail is approximately parallel to the cylinder axis of the drum that supports the clothing to be dressed. In addition, the dressing element in the previously known device can be moved against the pretensioning force of a spring in a direction that runs perpendicularly to the predetermined path. During the operation of the previously known device, the guide rail is mounted on a machine frame of the card or carding machine and then aligned by means of suitable adjusting mechanisms in such a way that the grinding stone assumes the desired working position. The grinding stone is then pulled away from the clothing against the pretensioning force of the pretensioning device by means of an actuating element mounted on it. The clothing is then set in rotation, the actuating element is released, and the grinding stone is pressed against the clothing by the force of the pretensioning device. In the further course of the dressing operation, the grinding stone is moved back and forth over the entire length of the cylindrical drum parallel to the cylinder axis, until the desired grinding result is obtained.

In a device of a similar design that is described in DE 199 32 679 C1, a cleaning effect is achieved by means of a cleaning blade that can be inserted in the clothing channels. In this regard, the cleaning blade is also forced towards the bottom of the channels by a pretensioning device. Of course, in the case of the device described in DE 199 32 679 C1, it is not necessary for the dressing element realized as a cleaning blade to be moved back and forth by means of an additional drive element, because the cleaning blade is automatically moved along the cylinder axis of the drum by the clothing, which is helically arranged on the cylindrical drum.

Although the devices described above produce satisfactory grinding and cleaning results, it has been found that the maintenance work carried out with these devices is very time-consuming. This results in considerable downtime of the fiber processing equipment and thus high costs related to lost production.

SUMMARY OF THE INVENTION

In view of the problems described above with respect to state-of-the-art devices, the object of the present invention is to develop devices of the type specified at the beginning, with which maintenance work on card clothing can be performed especially fast and inexpensively. A further object is to provide methods that can be used with devices of this type.

The object with respect to the inventive device is achieved by a refinement of the previously known devices, which is characterized essentially by a remote-controlled advancing mechanism for advancing the one or more elements of the dressing system.

The invention is based on the recognition that the maintenance work described above, such as the regrinding of clothing or the cleaning of clothing, in many cases is necessary only in a portion of the area of the clothing. On the other hand, in many cases it is not possible, for safety reasons, to operate the previously known devices of the type described above only in portions of the clothing. This is true especially of the grinding devices described above, because it is unsafe to release the grinding stone manually in the center of the carding element, such as the swift of a card, so that it is pressed against the clothing by the pretensioning device. This problem is especially evident in modern high-speed cards or carding machines, in which the clothing is drawn over a drum with a diameter of up to 2 m and a length of several meters. If a maintenance operation is necessary only in the center of a clothing of this type, to perform the manually initiated maintenance work, a maintenance person must remove the clothing cover and release the dressing element in the center of the clothing, while the clothing is rotating at high speeds. If the maintenance person comes within range of the clothing, grievous injuries may result.

For this reason, maintenance work performed with the previously known devices is usually performed over the entire axial length of the clothing, so that the dressing elements can be released at the edge of the clothing, which, however, still entails a great deal of risk.

In accordance with the invention, on the other hand, it is possible to release dressing elements of the dressing system from a safe distance and press them against the clothing to be dressed by advancing the dressing elements towards the clothing with the remote-controlled advancing mechanism. This makes it possible to dress individual, separate segments of the clothing in the center of the cylindrical drum and thus to achieve a significant reduction of the dressing time in cases of local wear and/or local fouling. More importantly, however, this device also makes it possible to perform all necessary dressing of the clothing without endangering the maintenance personnel, because now they merely have to operate the remote control for the advancing mechanism during the rotation of the clothing drum. Especially in view of the acceleration of the maintenance work, it was found that the additional expense of providing remote-controlled advancing mechanisms is quite acceptable, so that overall the maintenance work can be performed especially inexpensively with the device of the invention.

In accordance with the invention, it was found to be especially advantageous, if the element of the dressing system that can be advanced towards the clothing by the remote-controlled advancing mechanism can also be moved by the drive mechanism in the opposite direction from the advance direction, because this element can then be drawn away from the clothing without endangering any personnel, as the clothing continues to rotate without braking after the desired dressing operation in the dressed region has been completed. This allows further acceleration of the dressing of card clothings. In this regard, as described in U.S. Pat. No. 5,797,788 and DE 199 32 679, the dressing system likewise may have a slide that can be moved along the guide element with a support beam designed to support a dressing element that can be placed on the clothing. The disclosed content of the cited documents with respect to the design of the slide that can be moved along the guide element and with respect to the support beams is herewith incorporated in this specification by explicit reference.

From the standpoint of design and installation, it was found to be especially advantageous, if the advancing mechanism for advancing the dressing element by remote control can be operated together with the support beam, the slide, and/or the guide element. In this embodiment of the invention, the advancing mechanism can move the entire device consisting of the guide element and the dressing system towards the clothing. Therefore, to advance the dressing element, it is not necessary to use drive elements that can be moved along the predetermined path, but rather advancing elements arranged at a predetermined place on the predetermined path can be used to effect the required advancing movement. The design and installation of the device of the invention are simplified in this way.

To achieve the most stable possible support of the device of the invention, it was found to be advantageous for the advancing mechanism to have at least two advancing systems separated from each other in the direction of the predetermined path. In this regard, these advancing systems may be placed near opposite ends of the predetermined path.

To achieve simple installation of the device of the invention, it was found to be advantageous, on the one hand, for it to be possible to secure at least one advancing system of the advancing mechanism on a support element that is stationary with respect to the clothing to be dressed and, on the other hand, for it to be possible to couple it to the guide element, which is realized, for example, as a guide rail. In this regard, the guide rail may be designed in the same way as the guide rail of the previously known devices. The disclosed content of the documents cited above with respect to the design of the guide rail is herewith likewise incorporated in this specification by explicit reference.

In the design of the invention that has just been described, it was found to be especially advantageous from the design standpoint, if at least one advancing system has a first advancing slide that can be advanced in the advancing direction relative to the support element with a remote-controlled advancing element. In this regard, at least one advancing system can have a second advancing slide that is held by the first advancing slide and coupled to the guide element, and it is advantageous for it to be possible to move the second advancing slide in the advancing direction relative to the first advancing slide by means of a suitable actuating element. In this embodiment of the invention, after the device of the invention has been mounted on the machine frame of a card or carding machine, the guide element can first be aligned by means of the actuating elements with respect to the cylinder axis of the drum supporting the clothing. The advancing system for the actual dressing of the clothing can then be advanced towards the clothing by the advancing element to carry out the desired dressing of the clothing.

Although the advancing system of a device of the invention may also have a remote-controlled electric motor, to achieve especially good operational reliability, it was found to be advantageous, if the advancing system has a preferably double-acting pneumatic lifting cylinder, which is connected by suitable fluid lines with a control device that allows remote control of the lifting cylinder.

The device of the invention can be used to carry out a variety of maintenance operations. To this end, it is advantageous to provide at least one dressing element that can be releasably secured on the support beam, such as a polishing sponge, a grinding stone, a brush, or a cleaning blade. To adapt the device of the invention to the required maintenance operation, the previously used dressing element is removed from the support beam and replaced by the dressing element that is needed next.

Especially in connection with the performance of grinding work, a pretensioning device can be used, with which the dressing element of the dressing system is pushed towards the clothing to be dressed. Possible embodiments of this type of pretensioning device and their arrangement on the slide of the dressing system are specified in U.S. Pat. No. 5,797,788. The disclosed content of this document with respect to the design and arrangement of the pretensioning device is herewith incorporated in this specification by explicit reference.

As in the case of the previously known device, the device of the invention may have a drive mechanism for moving the dressing system along the predetermined path. In this regard, in an especially preferred embodiment of the invention, this drive mechanism can also be remotely controlled.

In this regard, by providing a coupling system for the releasable connection of the dressing system to the drive mechanism, it is possible to prevent damage to the drive mechanism during maintenance work, in the course of which a dressing element is automatically carried along by clothing helically arranged on the cylindrical drum. In this embodiment of the invention, the drive mechanism can first move the dressing system along the predetermined path to a starting point of the desired dressing operation. The dressing system is then uncoupled from the drive mechanism. It is then advanced towards the clothing by the remote-controlled advancing mechanism and automatically moved by the clothing helically arranged on the drum over the area to be dressed. The dressing element can then be pulled away from the clothing, and the dressing system can be recoupled to the drive mechanism to be moved to the next area to be dressed. To achieve fully automatic control of a device of the invention, at least one switching element located on the dressing system and/or the guide element can be assigned to the control device. The operation of this switching element can initiate a change in the movement of the dressing system along the predetermined path, or it can initiate an advancing movement and/or a movement in the opposite direction from the advancing direction. In this embodiment of the invention, after examination of the clothing to be dressed, the switching elements are positioned in the area of the clothing segments that are to be subjected to dressing.

As is evident from the above explanation, a method in accordance with the invention for dressing a card clothing with a device of the invention is essentially characterized by the fact that the dressing system is moved along the predetermined path to a starting point of the dressing and then advanced towards the clothing by remote control. In this regard, when the dressing system reaches an end point of the predetermined path, it can be pulled away from the clothing in the opposite direction from the advancing direction. When the dressing system reaches the starting point, it can be uncoupled from the drive mechanism, and/or when it reaches the end point, it can be coupled to the drive mechanism. It is advantageous to establish the starting point and the end point by appropriate positioning of suitable switching elements.

The various features of novelty, which characterize the invention, are pointed out with particularity in the claims annexed to and forming part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The sole drawing is a schematic representation of a device pursuant to the present invention.

DETAILED DESCRIPTION OF THE INVENTION

The device shown in the drawing comprises essentially a guide element realized as a straight guide rail 10, a dressing system 20 that can be moved along the guide rail 10, and an advancing mechanism that comprises a total of two advancing systems 30. The device shown in the drawing also comprises a drive mechanism 50, by which the dressing system 20 can be moved along the guide rail 10. To this end, the drive mechanism 50 is releasably coupled to the dressing system 20 by an electromagnetic coupling.

Each of the advancing systems 30 comprises a first advancing slide 32, which is mounted on a support element 40, which is only schematically indicated. The first advancing slide 32 can be moved in a direction perpendicular to the path predetermined by the guide rail 10. Each advancing system 30 also comprises a second slide 36, which can be moved perpendicularly to the path predetermined by the guide rail 10 in the direction relative to the first advancing slide 32 indicated by the double arrow A. The first slide 32 can be moved by a remote-controlled advancing element 34 in the direction perpendicular to the predetermined path, as indicated by the double arrow B.

In the embodiment of the invention shown in the drawing, the advancing element 34 is designed as a pneumatic lifting cylinder, whose stroke causes a total movement of 6 mm of the slide 36 mounted on the slide 32. The second slide 36 is mounted on the guide rail 10, so that a movement of the second slide 36 causes a movement of the guide rail 10 and thus of the dressing system 20, which can be moved along the guide rail 10. In addition, the second slide 36 can be moved in the direction indicated by double arrow A by an adjusting screw 38. After the device shown in the drawing has been mounted on the machine frame of a card or carding machine, first the adjusting screw 38 is used to produce the desired alignment of the guide rail 10 and thus the dressing system 20 with respect to the clothing to be dressed. The guide rail 10 and thus the dressing system 20 are then pulled away from the clothing by operating the pneumatic lifting cylinder 34, the clothing is set in rotation, and the dressing system 20 is advanced towards the clothing by further operation of the pneumatic lifting cylinder.

To dress the clothing, the dressing system 20 can first be moved by the drive mechanism 50 to the starting point of the area of the clothing that is to be dressed. After this starting point has been reached, the dressing system 20 is advanced towards the clothing by the pneumatic lifting cylinder 34. The dressing system 20 can then be moved by the drive mechanism 50 to the end point of the area to be dressed and then pulled away again from the clothing by the pneumatic lifting cylinder 34. Alternatively, when the starting point has been reached, it is also possible to uncouple the drive mechanism 50 from the dressing system 20 by operating the electromagnetic coupling 60. The dressing system 20 can then be carried along the path predetermined by the guide rail 10 by the clothing helically arranged on the drum until the end point of the area to be dressed is reached. The dressing system 20 is then recoupled to the drive mechanism 50 by appropriate operation of the electromagnetic coupling 60. The starting point and end point of the area to be dressed can be determined by means of switching elements 92, 94 mounted on the guide rail 10. These switching elements 92, 94 can be moved along the guide rail 10 and locked in place. The switching elements 92, 94 interact in such a way with a changeover contact lever 76 mounted on the dressing system 20 that, when the switching elements 92, 94 are reached, a change is initiated in the movement of the dressing system 20 along the predetermined path, or an advancing movement and/or a movement in the opposite direction from the advancing direction is initiated. The remote-control system shown in the drawing comprises a main switch 72, a switch 74 for adjusting the advancing speed of the dressing system 20 along the predetermined path, a switch 76 for coupling and/or uncoupling the dressing system 20 from the drive mechanism 50, a switch 78 for ending the advancing movement along the predetermined path, a switch 80 for advancing the dressing system 20 towards the clothing, a switch 82 for pulling the dressing system away from the clothing, and a switch 84 for starting movement of the dressing system 20 along the predetermined path. In this regard, the individual dressing operations can also be carried out fully automatically by remote control with the control unit 70 by starting the switches 72, 74, and possibly other switching elements and initiating preset movements of the dressing system 20 at this switching point.

The dressing system 20 comprises a slide 24, which can be moved along the guide rail 10 and holds a dressing element 22, such as a polishing sponge, grinding stone, or brush. The changeover contact lever 76 is also mounted on the slide 24. The dressing element 22 is releasably mounted on the slide 24 and thus can be replaced as needed, so that the device can be easily changed to a suitable form for the desired type of dressing.

For partial grinding or polishing of a clothing with the device shown in the drawing, the movement of the dressing system 20 along the predetermined path can be started by operating the switch 84. The switch 78 is used to stop the movement at the starting point of the dressing area, and the drive mechanism 50 is uncoupled from the dressing system 20 by operating the switch 76. The dressing system 20 is advanced towards the clothing to be dressed by operating the switch 80, and it is then carried along by the rotating clothing. When the end of the dressing area has been reached, the start button 84 is pushed again, and then the dressing system 20 is pulled away from the clothing by operating the pneumatic lifting cylinder again. The dressing system 20 is recoupled to the drive mechanism 50 by the electromagnetic coupling 60. The dressing system 20 is then moved back to the starting point of the dressing area. The dressing system is then located in its starting position again. This program may also be used to clean the whole clothing with a steel brush. This is done by pushing the start button and then immediately pushing the stop button. Two different speeds of the dressing system 20 along the guide rail 10 can be set with the preselection button 74: slow for large rolls, fast for small rolls.

The invention is not limited to the embodiment explained with reference to the drawing, but rather it is also conceivable for the advancing elements to be arranged directly on the slides that can be moved along the guide rail 10. In addition, two, three, or more advancing elements may be provided. Furthermore, electric motors can also be used instead of pneumatic lifting cylinders.

The invention is not limited by the embodiments described above which are presented as examples only but can be modified in various ways within the scope of the protection defined by the appended patent claims.

I claim:

1. A device for dressing a card clothing drawn over a preferably cylindrical drum, comprising: a guide element; a dressing system moveable along a path predetermined by the guide element, the dressing system including at least one element that is advanceable in a direction that runs transversely to the predetermined path; and a remote-controlled advancing mechanism for advancing at least one element of the dressing system.

2. The device in accordance with claim 1, wherein the at least one element is moveable by the drive mechanism in a direction opposite the advancing direction.

3. The device in accordance with claim 1, wherein the dressing system includes a slide arranged to be moveable along the guide element, the slide having a support beam configured to support a dressing element that is placeable against the clothing.

4. The device in accordance with claim 3, wherein the advancing mechanism is configured to be operable together with at least one of the support beam, the slide, and the guide element.

5. The device in accordance with claim 1, wherein the advancing mechanism includes at least two advancing systems that are separated from each other in a direction of the predetermined path.

6. The device in accordance with claim 5, wherein at least one advancing system of the advancing mechanism is securable on a support element that is stationary with respect to the clothing to be dressed and is coupleable to the guide element.

7. The device in accordance with claim 6, wherein at least one of the advancing systems has a remote-controlled advancing element and a first advancing slide that can be advanced in the advancing direction relative to the support element by the remote-controlled advancing element.

8. The device in accordance with claim 7, wherein the at least one advancing system has a second advancing slide that is held by the first advancing slide and is coupled to the guide element so that the second advancing slide is moveable relative to the first advancing slide in the advancing direction.

9. The device in accordance with claim 8, and further comprising an operating element operatively arranged to move the second advancing slide relative to the first advancing slide.

10. The device in accordance with claim 9, wherein the operating element is an adjusting screw.

11. The device in accordance with claim 5, wherein the advancing system includes a double-acting pneumatic lifting cylinder.

12. The device in accordance with claim 3, wherein the dressing element is releasably secured on the support beam.

13. The device in accordance with claim 12, wherein the dressing element is one of a polishing sponge, a grinding stone, a brush, and a cleaning blade.

14. The device in accordance with claim 1, and further comprising a pretensioning device operatively arranged to push a dressing element of the dressing system towards the clothing to be dressed.

15. The device in accordance with claim 1, and further comprising a remote-controlled drive mechanism operative to move the dressing system along the predetermined path.

16. The device in accordance with claim 15, and further comprising a coupling system for releasably coupling the dressing system to the drive mechanism.

17. The device in accordance with claim 15, and further comprising a control device for controlling at least one of the advancing mechanism and the drive mechanism.

18. The device in accordance with claim 17, and further comprising at least one switching element located on at least one of the dressing system and the guide element, the switching element being in operative connection with the control device so that operation of the switching element initiates a change in movement of the dressing system along the predetermined path, or initiates at least one of an advancing movement and a movement in the opposite direction from the advancing direction.

19. A method for dressing a card clothing having with a device for dressing a card clothing drawn over a preferably cylindrical drum, the device having a guide element, a dressing system moveable along a path predetermined by the guide element, the dressing system including at least one element that is advanceable in a direction that runs transversely to the predetermined path, and a remote-controlled advancing mechanism for advancing at least one element of the dressing system, the method comprising the steps of:

moving the dressing system along the predetermined path until it reaches a starting point of the dressing operation; and then advancing the dressing system towards the clothing by remote control.

20. The method in accordance with claim 19, further including the step of drawing back the dressing system from the clothing in a direction opposite the advancing direction when the dressing system reaches an end point of the predetermined path.

21. The method in accordance with claim 20, including at least one of uncoupling the dressing system from the drive mechanism when the dressing system reaches the starting point and coupling the dressing system to the drive system when the dressing system reaches the end point.

* * * * *